United States Patent [19]

Chubb et al.

[11] 4,049,064

[45] Sept. 20, 1977

[54] MULTI FUNCTION DRILL DRIVE SYSTEM

[75] Inventors: Raymond L. Chubb, Garland; Lawrence F. Haven, Dallas; Robert W. Hisey, Richardson, all of Tex.

[73] Assignee: Gardner-Denver Company, Dallas, Tex.

[21] Appl. No.: 682,355

[22] Filed: Apr. 30, 1976

[51] Int. Cl.[2] ..... B23Q 5/00

[52] U.S. Cl. ..... 173/147; 192/.084; 254/173 R

[58] Field of Search ..... 74/335, 856, 857, 859–861; 173/147; 192/.084; 254/173 R; 408/17

[56] References Cited

U.S. PATENT DOCUMENTS

| | | | |
|---|---|---|---|
| 1,899,703 | 2/1933 | Lindner | 254/173 R |
| 2,972,388 | 2/1961 | Thornburg | 173/147 X |
| 3,072,203 | 1/1963 | Bendixen | 173/147 X |
| 3,198,263 | 8/1965 | Reischl | 173/147 X |
| 3,306,133 | 2/1967 | Rhein et al. | 74/861 X |
| 3,867,989 | 2/1975 | Hisey et al. | 173/147 |

FOREIGN PATENT DOCUMENTS

| | | | |
|---|---|---|---|
| 819,385 | 9/1959 | United Kingdom | 173/147 |

*Primary Examiner*—Lawrence J. Staab

*Attorney, Agent, or Firm*—Richards, Harris & Medlock

[57] ABSTRACT

A drive system for a hoist-pulldown linkage of a blast hole drill employs a variable speed electric motor and a variable ratio coupling between the motor and the hoist-pulldown linkage. A first regulator actuates the electric motor for high torque operation when the ratio of the coupling is low. A second regulator means activates the electric motor for low torque operation when the ratio of the coupling is high. Transfer in coupling ratio is coordinated with change between regulators. The first regulator means is a voltage regulator with a current spillover limit. The second regulator is a voltage regulator with an adjustable pulldown force limit with means to select the rotational speed reference of the motor.

4 Claims, 7 Drawing Figures

MULTI FUNCTION DRILL DRIVE SYSTEM

This invention relates to blast hole drills, and more particularly to the control of motive power for the performance of a plurality of power actuated functions on a drill unit with selectively different characteristics.

A rotary earth drilling machine is shown in U.S. Pat. No. 3,867,989 in which a drill pipe carrying a drill bit on the end thereof is rotated by a rotary table located at the floor level and wherein a drilling mast is provided with a pulldown frame which is adapted to be screwed onto the drill pipe as it extends above the rotary table. U.S. Pat. No. 2,869,826 illustrates a tophead drive arrangement in which a motor providing rotary drive to the drill stem is moved along the mast by a hoist-pulldown mechanism. In either case it is desirable to be able to hoist (raise and lower) the drill string with one drive characteristic and to exert a pulldown force while actually drilling with a different characteristic. It is further desired that the same drive electric motor employed for powering the hoist and pulldown mechanism also be employed to propel the drill unit from one location to another.

In U.S. Pat. No. 3,867,989 a system is disclosed in which a rotary drive, a crawler drive and a hoist mechanism are all driven by an electric motor. However, in pulldown operations, a hydraulic motor is employed. Prior drilling systems have thus involved the conventional use of hydraulic motors in order to provide the necessary pulldown force characteristics. The present invention eliminates the hydraulic motor and provides electric drive motor performance altered so that it will properly function during pulldown.

In accordance with one aspect of the invention, a drive system is provided for a hoist-pulldown linkage of a blast hole drill. A variable speed electric motor drives a variable ratio coupling between the motor and the hoist-pulldown linkage. A first regulator means actuates the electric motor for high torque mode when the ratio of the coupling is low. A second regulator means activates the electric motor for low torque mode when the ratio of the coupling is high. The first regulator means is a voltage regulator with a current spillover limit. The second regulator is a voltage regulator with an adjustable pulldown force limit with means to select the rotational speed reference of the motor. Transfer between modes and regulators is coordinated.

In a further aspect, an earth drilling apparatus having an elongated upstanding mast and a rotary drive means to drive a drill pipe and transverse means connected to the drill pipe and mounted on the mast is provided for linear movement therealong to transmit pulldown and hoisting forces to said drill string. A variable speed electric motor is operable in a first or hoist mode at high speed and high torque. Means are provided for altering the control of the motor for operation in a second or pulldown mode for a high pulldown force produced at low torque and low speed. The motor control is changed between the first mode and second mode coincident with alteration of the drive linkage between the motor and the hoist-pulldown mechanism.

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

Figures 1, 4:
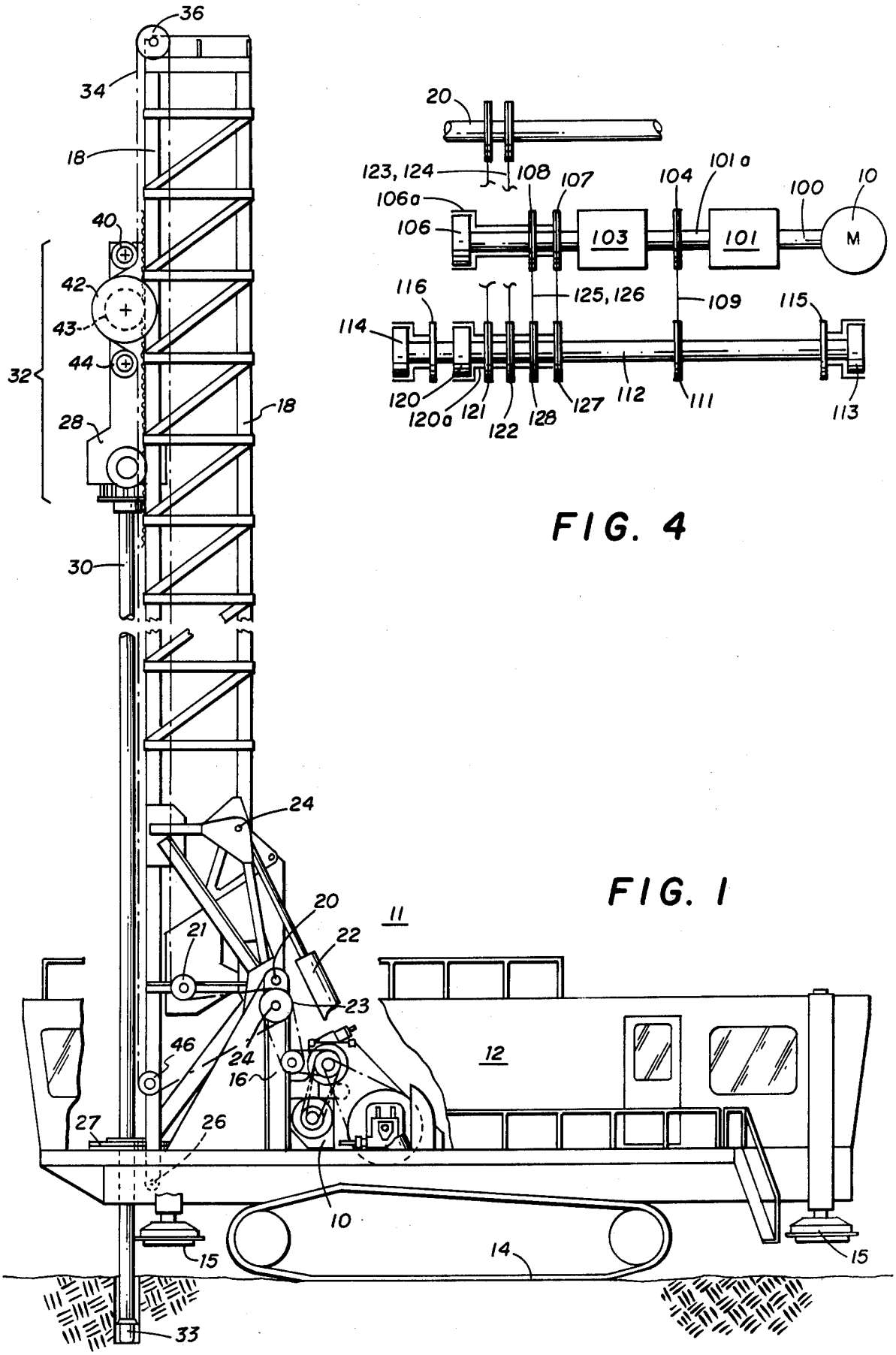
FIG. 1 is a side elevation of a rotary earth drilling apparatus including a selective drive in accordance with the present invention.
FIG. 4 is a schematic view showing the power train of the system of FIGS. 1–4.

Referring now to FIG. 1, the present invention involves utilization of a motor 10 to perform a plurality of functions, serving as a primary motive power source for the rotary drill 11. Drill 11 is of the type used to create large blast holes required for large scale surface mining in mineral exploitation. Drill 11 comprises a frame 12 mounted on crawlers 14. The frame 12 has a plurality of leveling jacks 15 connected thereto which are shown retracted but normally are lowered preparatory to drilling for leveling and supporting drill 11. The frame 12 includes support means 16 for supporting an elongated mast 18 about a pivot shaft 20. The mast 18 at the rear of the unit is adapted to be raised from a substantially horizontal position to the erect or working position shown by a pair of hydraulic cylinders 22 (one shown) connected between frame 12 and mast 18 at a pivot 24. Mast 18 is secured in the erect position by a suitable removable pin-type connection 26. A rotary top head drive 28 serves to rotate a drill string 30 and a drill bit 33 mounted on the lower end thereof. The top head drive 28 is constructed generally in accordance with well known principles of drill design having an electric drive motor.

The mast 18 is of the type described in U.S. Pat. No. 3,867,989. A rotary head 32 supports top head drive 28 which engages the upper end of the drill string 30. Rotary head 32 travels along a suitable guide on mast 18 as it moves under pulldown and hoist forces applied thereto through two chains, only one of which, the chain 34, being shown. Chain 34 is driven by a suitable sprocket 23 near shaft 20. Chain 34 is continuous and courses upward from the sprocket (on shaft) 21 and passes over an idler 36 at the top of mast 18 and thence downward to idler 40, drive sprocket 42, idler 44 and thence downwardly to pass over idler 46. A second chain on the side of the mast opposite the chain 34 follows a similar course but passes over idler sprockets and a drive sprocket (not shown). The drive sprockets are mounted on the rotary head 32 and drive a pinion 43 which engages racks mounted on the outside faces of the two rear corner members of mast 18. Pinions 43 are maintained enmeshed with the racks by followers (not shown) secured to rotary head 32 and engaging inside surfaces on mast 18.

In the setting of the drill 11, the present invention provides for the control of motor 10 such that it can be utilized as a motive power source (a) for driving the crawler 14 to propel the unit 11 from one location to another, and (b) for providing the necessary drive for the shaft 20 during hoist and pulldown operations.

Motor 10, by mechanical gearing and clutching, provides traction to the crawler drive 14. Motor 10 is also mechanically geared and clutched to perform fast hoist of rotary head 32. Fast hoist operations are distinguished from pulldown operations by the range of speeds employed and the forces involved. Hoist speed generally is greater than pulldown mode speed and the motor torque involved generally is much greater in hoist mode than in pulldown mode. The system is such that motor 10 can be operated at reduced torques and different speeds to provide the most appropriate hoist and pulldown forces.

In accordance with the present invention, a first control for motor 10 is provided for operation in the propel and fast hoist modes. A first regulator has voltage regulation with current spillover and a current limit in order to utilize the full capacity of the motor in propel and fast hoist modes. The operator controls motor 10 in hoist or propel modes with a single control input which is manually operated. It is utilized to establish a voltage set point.

In the electric pulldown mode, the motor 10 is automatically controlled by a second and separate regulator. The second regulator is a voltage regulator with an adjustable current, thus a pulldown force limit. A first manual control sets the voltage and thus the speed and direction reference. A second manual control establishes current, thus the pulldown force. The two manual inputs enable an operator to adjust the motor speed and pulldown force to meet the drilling requirements of the material encountered by the bit 32. In normal drilling operation, the operator would establish a pulldown force by adjusting one manual control and establishing the maximum penetration rate with the second manual control to suit the material being drilled and to assure maximum penetration rate at a constant pulldown force.

Figure 2:
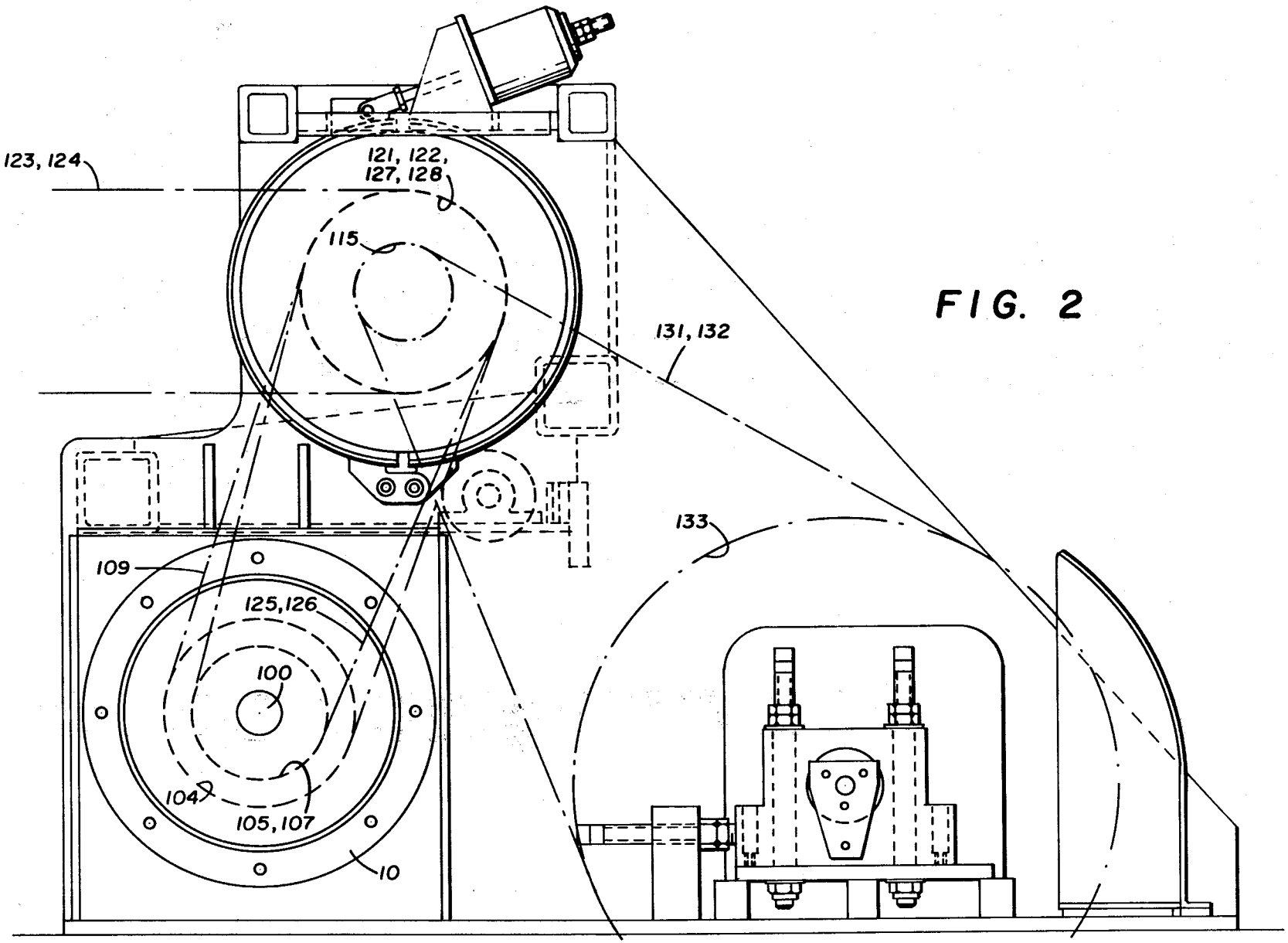
FIG. 2 is an enlarged side elevation of the selectively actuated drive system in accordance with the present invention.
Figure 3:
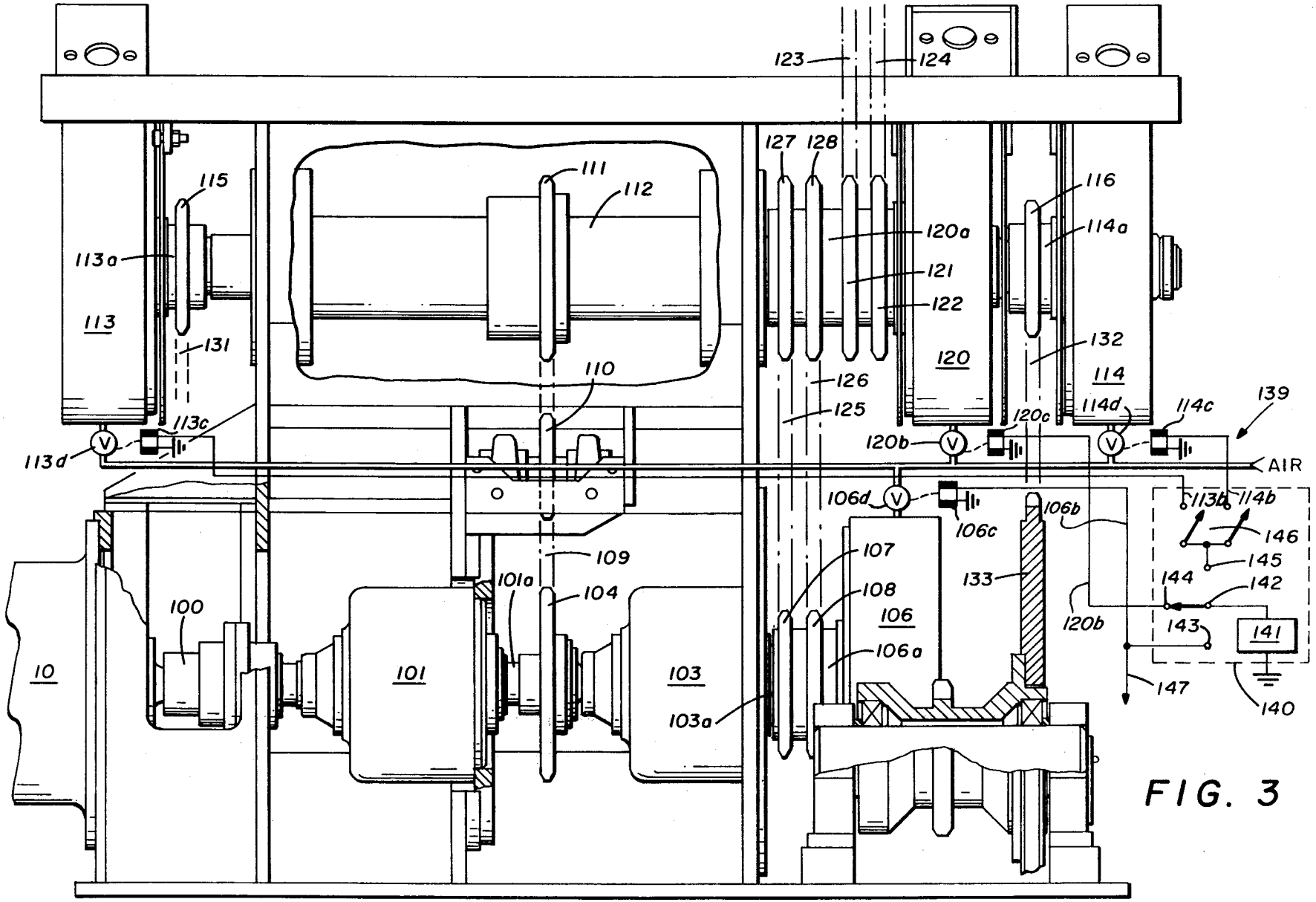
FIG. 3 is a top view of the drive system of FIG. 2.
Figure 5:
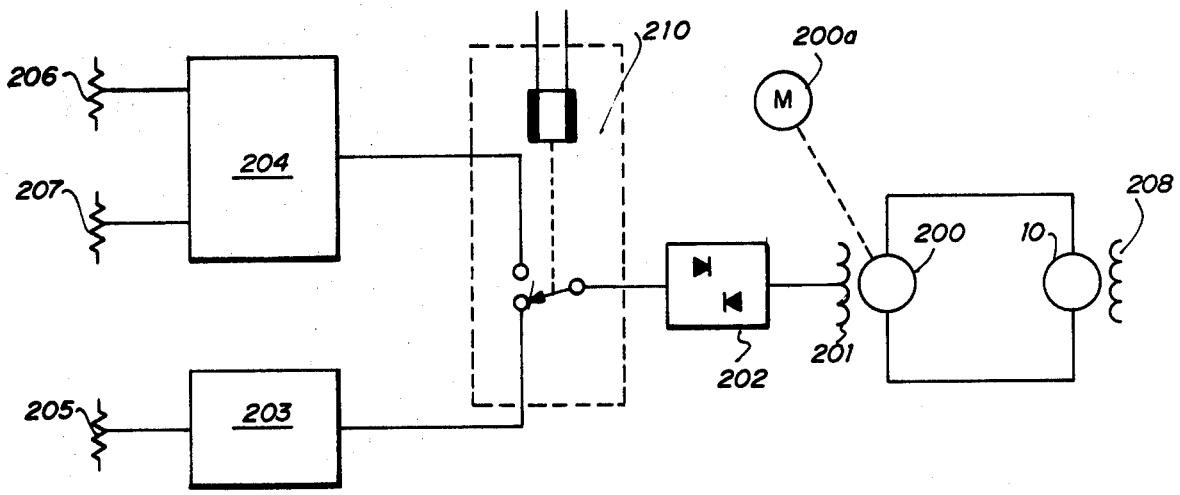
FIG. 5 is a block diagram illustrating selective control for the drive motor of the present invention.
Figure 6:
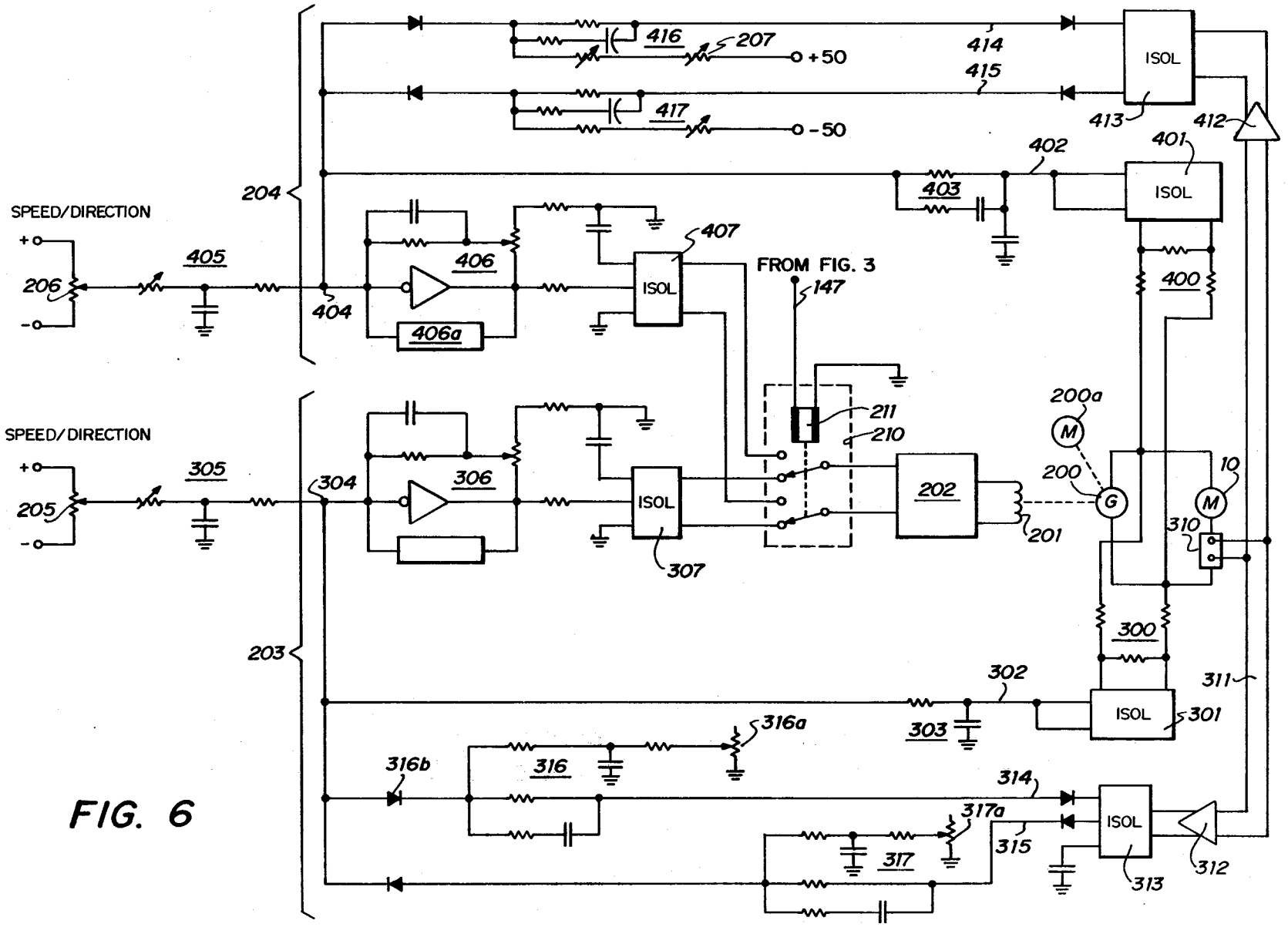
FIG. 6 is a more detailed schematic diagram of a control system of FIG. 5 typical of the present invention.

The mechanical system illustrated in FIGS. 2–4 is utilized in conjunction with the electrical system illustrated in FIGS. 5 and 6 to accomplish the foregoing.

Referring to FIGS. 2–4, motor 10 has an output shaft 100 coupled to a gear reducer 101 having an output shaft 101*a*. Shaft 101*a* drives a gear reducer 103 and also drives a sprocket 104. The output shaft 103*a* from gear reducer 103 is coupled to a clutch 106. The output shaft 106*a* of clutch 106 is coaxial with shaft 103*a* and carries a pair of sprockets 107 and 108. Sprocket 104 is connected by a chain 109 which passes over an idler sprocket 110 and onto a sprocket 111 mounted on a clutch shaft 112. Clutch shaft 112 is coupled to clutches 113 and 114 thereby selectively to drive sprockets 115 and 116 which are mounted on shafts 113*a* and 114*a* which are coaxial with shaft 112. Sprockets 115 and 116 are coupled to the propel drive for the crawler unit 14.

A hoist clutch 120 is mounted to be driven by shaft 112. The output shaft 120 *a* of clutch 120 drives a pair of sprockets 121 and 122 which are coupled by chains 123 and 124 to sprockets secured to shaft 20 of FIG. 1 thereby to drive chain 34. Clutches 106, 113, 114 and 120 are air operated clutches with electrically operated solenoid valves for control thereof.

The output shaft 106*a* of pulldown clutch 106 drives sprockets 107 and 108 and is coupled by chains 125 and 126 to sprockets 127 and 128 which are mounted along with sprockets 121 and 122 on shaft 120*a*. It will be noted that sprocket 115 drives chain 131 and sprocket 116 drives chain 132. Chain 132 drives the sprocket 133 which leads to one side of the crawler 14. A similar propel sprocket for the other side has not been shown.

The mechanism illustrated in FIGS. 2 and 3 is mounted on a suitable framework to be nested in the unit 11 as shown in FIG. 1. In operation, gear reducers 101 and 103 each successively lower the speed of the shaft drive. Sprocket 104 through chain 109 and sprocket 111 continuously drives the clutch shaft 112. When clutches 113 and 114 are energized, the motive power from shaft 112 propels drill 11 from one location to another.

When clutch 120 is energized, motive power from shaft 112 is then coupled to shaft 120*a* to drive chains 123 and 124 through sprockets 121 and 122 for fast hoist operations. During hoist operations, sprockets 127 and 128 drive chains 125 and 126 so that sprockets 107 and 108 are driven as idlers.

When clutch 120 is deenergized and clutch 106 is energized, the motive power from gear reducer 103 is coupled through clutch 106 to a shaft 106*a*. Sprockets 127 and 128 are driven to drive sprockets 121 and 122 also mounted on shaft 120*a*.

Clutches 106, 113, 114 and 120 are of the air actuated type. A compressed air supply line 139 leads to each of the clutches which are to be selectively energized through a clutch control unit 140. More particularly, control lines 106*b*, 113*b*, 114*b* and 120*b* lead to air control solenoids 106*c*, 113*c*, 114*c* and 120*c*, respectively. The latter solenoids actuate valves 106*d*, 113*d*, 114*d* and 120*d*, respectively, thereby selectively to actuate clutches 106, 113, 114 and 120 representative of the means generally provided for energizing and deenergizing such clutches.

A source 141 is connected to a selector switch 142. When connected to a first terminal 143, the pulldown clutch 106 is energized. When connected to the terminal 144, the hoist clutch 120 is energized. When connected to terminal 145, either or both of clutches 113 and 114 may be energized through switches 146 to control propel operations in moving from one location to another.

In accordance with the present invention, the characteristics of the control of motor 10 are altered when in the pulldown mode. This may be accomplished by extending a line 147 from terminal 143 to a motor control unit shown in FIGS. 5 and 6.

Referring to FIG. 5, motor 10 of FIGS. 1–4 is shown as driven by current from a generator 200 which is mechanically driven from an engine 200*a* or a constant speed motor. A field winding 201 of generator 200 is excited from an SCR exciter 202. The exciter 202 is selectively actuated from a hoist-propel control unit 203 or from a pull down control unit 204. The hoist-propel unit 203 is provided with a hand actuated rheostat 205 to control hoist and propulsion speeds. Pulldown control unit 204 has a hand actuated rheostat 206 to control speed and a similar rheostat 207 to control the armature current, thus the pulldown force. The field winding 208 of motor 10 is controlled by a variable excitation source to provide a measure of adjustment of the torque output as will be explained.

A control selector switch unit 210 serves to interconnect either the control unit 203 or control unit 204 to exciter 202. The switches in unit 210 are actuated by a solenoid 211 which is energized in coincidence with actuation of the clutch 106 of FIGS. 3 and 4. When clutch 106 is energized and the propel clutches 113 and 114 and the hoist clutch 120 are deenergized, exciter 202 is subject to control from regulator 204.

The particular hoist-propel control unit 203 as shown is of the type manufactured and sold by General Electric Company and identified as a Directo-Matic II Integrated Process Control. The control units 203 and 204 are illustrated in the diagram of FIG. 6.

The particular control unit 204 as shown is somewhat similar in overall configuration to unit 203 but provides for significantly different operating characteristics for the motor 10 as will be described.

The field energizing control circuit 203 is described in General Electric Company publication No. 68A999599 which is incorporated herein by reference. It briefly will be here described. Circuit 203 controls field energization of generator 200 when switch unit 210 is in the position shown in FIG. 6. The voltage across motor 10 from generator 200 is reduced through a network 300 and is applied to an isolation unit 301. Isolation unit 301 serves to produce on output line 302, a D.C. voltage, having reference to ground but of the same magnitude as the voltage applied thereto from network 300. This is necessary to provide isolation between the motor armature loop and the regulator. The voltage on line 302 is coupled by RC network 303 to a feedback summing point 304.

A speed-direction input signal from potentiometer 205 is also applied to summing point 304 by way of the RC linkage 305. Thus, the input control voltage from potentiometer 205 and the feedback voltage from circuit 300–303 are summed at point 304. The sum signal is applied to an amplifier circuit 306 the output of which is applied by way of an isolation unit 307 and switch unit 210 to the exciter 202.

Circuit 300–303 provides voltage feedback for control of excitation of motor 10 so that it will operate at the reference voltage (speed) point.

In addition, current feedback is provided by way of a current sensing shunt unit 310 in circuit with the armature of motor 10. Unit 310 is connected by way of circuit 311 and an amplifier 312 to an isolation unit 313. Two polarity dependent signals appear at the outputs 314 and 315 of the isolation unit 313 and are proportional to current flow in motor 10 but are referenced to ground. One signal is then applied by way of network 316 to the summing point 304. The opposite polarity signal is applied by way of network 317 to the summing point 304. Thus, excitation of generator 200 is voltage controlled through the circuit 300–303 with current spillover and limit by way of circuits 316 or 317.

Figure 7:
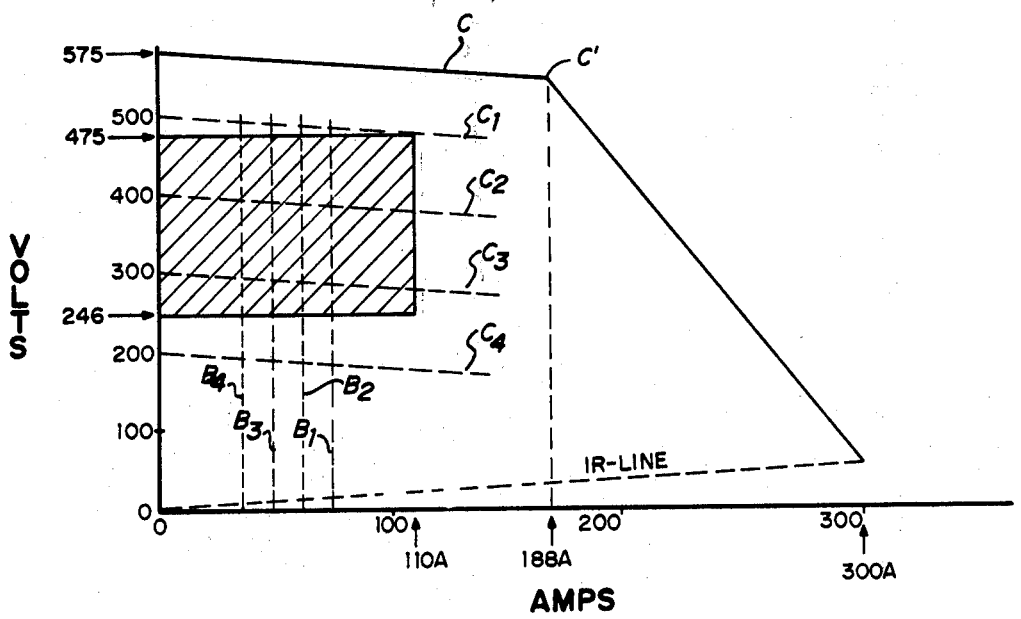
FIG. 7 illustrates the variation in control characteristics involved in operating the system of FIGS. 1–6.

In FIG. 7, the generator first quadrant output curve is illustrated. The curves given are used with an 88 horsepower blower ventilated 1245 r.p.m. 475 volt 150 ampere RMS armored motor type MDV-806-AA with a 144 volt shunt field. Voltage applied to motor 10 is plotted as ordinates. Motor current, in amperes, is plotted as abscissa.

When under the control of the unit 203, the motor operates in accordance with curve C where the speed of the motor 10 and its direction is initially selected by the voltage from potentiometer 205. The curve C has a sharp discontinuity C′ where current spillover occurs in either circuit 314 or 315. The point C′ can be selected by adjustment of potentiometers 316*a* or 317*a* for the two directions in which motor 10 may operate. The voltage on channel 314 must exceed the bias from network 316 as controlled by the setting of potentiometer 316*a* as applied to diode 316*b* before the current control begins to have an effect. In FIG. 7, the bias is so selected that the characteristic changes at a selected current level which in the example given is at about 188 amperes. The change in characteristic in accordance with curve C is desired because of the power limitations of the drive system and machinery.

Referring again to FIG. 3, when line 147 is energized coincident with energization of the pulldown clutch 106, solenoid 211 actuates the switch unit 210 so that the control of excitation of motor 200 is derived from control unit 204.

In unit 204, the voltage across the motor 10 is sensed and reduced by a network 400. The reduced voltage is applied to an isolation unit 401. The output from isolation unit 401 appears on line 402 and is applied by way of network 403 to the summing point 404.

The speed/direction input control signal from potentiometer 206 is applied by way of RC network 405 to the summing point 404 as a voltage reference input. The voltage at point 404 is then applied by way of the amplifier circuit 406 to the isolation unit 407. The output of isolation unit 407 is applied by way of switch unit 210 to exciter 202.

Further, the current dependent signal on channel 311 is applied by way of amplifier 412 to isolation unit 413. The two current dependent signals are then applied from channels 414 and 415 through biasing networks 416 and 417 to the summing point 404. Pulldown regulator unit 204 thus serves as a basic four-quadrant voltage regulator with a nonintegrating main signal summing amplifier 406. A high gain (approximately 90° slope) current limit function is provided for both polarities of armature current.

The current limiting characteristics are shown in FIG. 7 by the constant current spillover curve B. The location of line B is determined by the bias which is determined by adjustment of potentiometer 207. The maximum possible pulldown speed of the motor is determined by the setting of the potentiometer 206. When motor 10 is in the pulldown mode, it can be caused to perform in accordance with any one of a plurality of curves C1, C2, C3 or C4 as determined by the setting of the potentiometer 206. The force exerted by the motor and pulldown operation will be determined by a setting of the potentiometers 207 and can be such as to cause operation represented by the vertical curves B1, B2, B3 and B4.

In operation an operator adjusts switch 142 to energize the pulldown clutch 106. The desired force is selected by adjusting the potentiometer 207. The motor speed is selected by the potentiometer 206.

While the control circuits shown in FIG. 6 have been identified with particularity by reference to certain General Electric products, it will be understood that different specific circuits may be employed so long as the characteristics described above result. It will further be appreciated that the drive system for propel, hoist and pulldown may be utilized with systems where the rotary drive for the drill stem is provided either by rotary table as in U.S. Pat. No. 3,867,989 or in connection with a top head drive as generally indicated in Pat. No. 2,869,826. In either case, by setting the pulldown force and the upper speed limit as indicated in FIG. 7, the motor will operate at a variable speed depending upon the nature of the formations encountered by the drill bit.

Having described the invention in connection with certain specific embodiments thereof, it is to be understood that further modifications may now suggest themselves to those skilled in the art and it is intended to cover such modifications as fall within the scope of the appended claims.

What is claimed is:

1. In an earth drilling apparatus having an elongated upstanding mast and a drive means to drive a drill pipe through a traverse means connected to the drill pipe and mounted for movement along the length of the mast to transmit hoist and pulldown forces to the drill string, the combination therewith which comprises:

a. a variable speed motor coupled in driving relation through a reduction unit to a high torque shaft, b. a clutch shaft driven in accordance with the input to said reduction unit, c. a first clutch for driving an output shaft in accordance with said clutch shaft, d. means for driving said traverse means in accordance with said output shaft, e. a second clutch for alternatively driving said output shaft from said high torque shaft, and f. means for changing the operating mode of said motor and shifting energization from one of said clutches to the other.

2. The system according to claim 1 in which a first regulator means actuates said electric motor for high torque operation when said second clutch is energized, and a second regulator means actuates said electric motor for low torque operation when said first clutch is energized.

3. The combination set forth in claim 2 in which said first regulator means is a voltage regulator with a current spillover limit.

4. The combination set forth in claim 2 in which said second regulator is a voltage regulator with an adjustable pulldown force limit with means to select the rotational speed reference of said motor.

* * * * *